United States Patent [19]

Böttcher et al.

[11] 4,131,501

[45] Dec. 26, 1978

[54] METHOD AND APPARATUS FOR SPLICING RUNNING WEBS OF LOW TENSILE STRENGTH

[75] Inventors: Hubert Böttcher; Joachim Pfannmüller; Hartmut Kaebernick, all of Hamburg; Wolfgang Steiniger, Börnsen; Horst-Dieter Preuss, Hamburg, all of Fed. Rep. of Germany

[73] Assignee: Hauni-Werke Körber & Co. KG., Fed. Rep. of Germany

[21] Appl. No.: 856,573

[22] Filed: Dec. 1, 1977

[30] Foreign Application Priority Data

Dec. 9, 1976 [DE] Fed. Rep. of Germany ..... 2655791

[51] Int. Cl.[2] ..... B65H 19/08

[52] U.S. Cl. ..... 156/157; 156/164; 156/269; 156/309; 156/351; 156/367; 156/494; 156/504; 156/505; 156/511; 226/113; 226/114; 226/195; 242/58.3; 242/58.4

[58] Field of Search ..... 156/159, 164, 269, 351, 156/362, 367, 494, 504, 505, 309, 515, 157, 511; 242/58.3, 58.4; 226/113, 114, 195

[56] References Cited

U.S. PATENT DOCUMENTS

| | | | |
|---|---|---|---|
| 3,089,661 | 5/1963 | Phillips et al. | 242/58.3 |
| 3,516,617 | 6/1970 | Haner et al. | 156/504 |
| 3,713,600 | 1/1973 | Murray et al. | 242/58.4 |
| 3,749,634 | 7/1973 | Krause | 156/505 |
| 3,896,820 | 7/1975 | Ludszeweit et al. | 156/504 |
| 3,933,569 | 1/1976 | Grasvoll | 156/515 |
| 3,989,576 | 11/1976 | Collin et al. | 156/504 |

*Primary Examiner*—Jerome W. Massie
*Attorney, Agent, or Firm*—Peter K. Kontler

[57] ABSTRACT

A fresh web of cigarette paper or the like is spliced to the running web by a uniting band, which is adhesive at both sides, after the fresh web is accelerated to the speed of the running web. The uniting band is placed between the running web and the leader of the fresh web, and the running web is shifted sideways to adhere to the adjacent side of the uniting band as well as to move the other side of the uniting band against the fresh web as soon as the speed of the fresh web rises to that of the running web. The running web is severed behind the moving uniting band, and the fresh web is severed ahead of the moving uniting band. Severing of the fresh web is preceded by relaxation of tensional stress upon the leader of the fresh web in response to displacement of a guide roller which engages the fresh web between a stationary knife for the fresh web and a pair of motor-driven advancing rolls which pull the leader of the fresh web in the course of and subsequent to completed acceleration of the fresh web.

18 Claims, 1 Drawing Figure

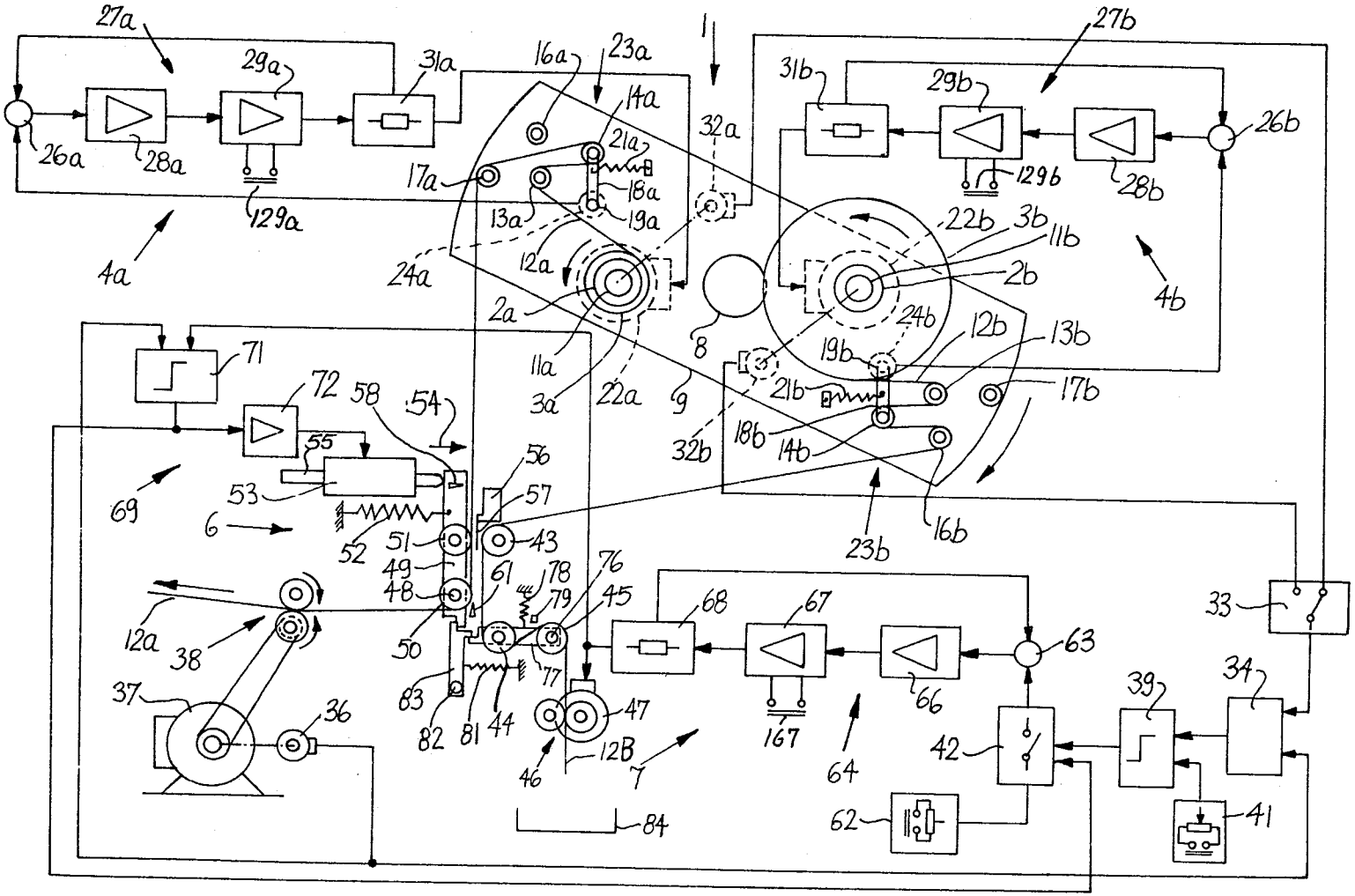

METHOD AND APPARATUS FOR SPLICING RUNNING WEBS OF LOW TENSILE STRENGTH

BACKGROUND OF THE INVENTION

The present invention relates to a method and apparatus for splicing a fresh web to a running web. More particularly, the invention relates to improvements in a method and apparatus for making a splice between running and fresh webs by means of a uniting band which is adhesive at both sides thereof. Still more particularly, the invention relates to improvements in a method and apparatus which can be utilized with advantage for splicing running and fresh webs of relatively low tensile strength. Typical examples of such commodities are webs of cigarette paper or other strip-shaped material which is used in connection with the manufacture and/or processing of smokers' products including plain or filter tipped cigarettes, cigars or cigarillos, filter rod sections and packages and/or cartons for cigarettes or the like.

It is already known to employ a uniting band for the splicing of the leader of a fresh web to the running web, and it is also known to initiate the splicing operation in response to exhaustion or near exhaustion of the supply of running web. The supply of the running web is monitored and the fresh web is accelerated to a speed which is at least slightly less than the speed of the running web before the webs are caused to contact the respective adhesive-coated sides of a uniting band therebetween. Thus, the fresh web invariably undergoes abrupt additional acceleration as soon as it comes in contact with the uniting band or as soon as the uniting band comes in contact with the running web, depending upon whether the uniting band is contacted by the fresh web subsequent or prior to contacting the running web. Such mode of splicing presents no problems when the material of the webs exhibits a pronounced tensile strength, i.e., when the fresh web and/or the running web is not likely to break in response to abrupt acceleration of the fresh web to the exact speed of the running web. For example, a web of metallic foil, paper or lightweight cardboard which is used for the making of inner or outer envelopes of cigarette packs can stand rather pronounced tensional stresses. However, the tensile strength of cigarette paper is very low. Furthermore, the trend in the cigarette making is toward the use of highly porous cigarette paper whose tensile strength is extremely low. In fact, many manufacturers of cigarettes demand that the permeability of highly porous cigarette paper be reduced still further, for example, by making holes with the help of needles, one or more laser beams and/or electrodes which combust portions of a running web at regular intervals. Increased permeability of cigarette paper webs, e.g., in the region of mouthpieces of filter cigarettes, is considered to be desirable in order to allow relatively large amounts of atmospheric air to enter the column of smoke flowing into the smoker's mouth. The admixed atmospheric air is believed to facilitate regulation of the percentage of nicotine and condensates which are inhaled by the smoker.

The problems which arise in connection with automatic or semiautomatic splicing of fresh webs of highly porous cigarette paper to running webs are further aggravated by continuous increase in the output of cigarette making and like machines. Thus, the likelihood of breaking a highly porous cigarette paper web whose tensile strength is extremely low is further enhanced if the web is to travel at a speed which is necessary to turn out up to and well in excess of seventy cigarettes per second.

Acceleration of a fresh web to a speed which is less than the speed of the running web was considered to be not only advisable but actually necessary because such mode of splicing allows for convenient separation of surplus of the leader of a fresh web from that portion of the fresh web which is attached to the running web. All that is necessary is to place a stationary knife into the path of movement of the fresh web ahead of the uniting band. When the fresh web undergoes abrupt acceleration as a result of splicing to the running web, the slowly moving surplus is moved against and is severed by the stationary knife.

OBJECTS AND SUMMARY OF THE INVENTION

An object of the invention is to provide a simple but highly reliable method of making strong splices between running and fresh webs whose tensile strength is very low.

Another object of the invention is to provide a splicing method which can be practiced by resorting to simple and compact apparatus and which invariably produces a satisfactory splice even if the material of the webs offers low resistance to breaking or tearing, not only because the webs are thin and porous but also because the splicing operation must be carried out while the webs are caused to advance at an elevated speed in the range of several hundred meters per minute as well as because the material of the webs has been weakened on purpose.

A further object of the invention is to provide an automatic splicing method which insures that the quantity of material which is wasted preparatory to and/or during or after the making of a splice is negligible.

An additional object of the invention is to provide a splicing apparatus which can be utilized for the practice of the above outlined method, whose operation is fully or practically fully automatic, which can produce high-quality splices and whose operation does not entail substantial losses in the material of webs.

Another object of the invention is to provide the splicing apparatus with novel and improved means for preparing the surplus of the leader of the fresh web for separation from the major part of the supply of fresh web in the course of or subsequent to the making of a splice.

An ancillary object of the invention is to provide the apparatus with novel and improved means for ascertaining the optimum circumstances for attachment of the fresh web to a running web.

Another object of the invention is to provide an apparatus which can make a splice between running and fresh webs in such a way that neither of the webs is subjected to abruptly increasing tensional stresses of the order likely to result in breakage of the fresh and/or running web.

One feature of the invention resides in the provision of a method of splicing a fresh web to a running web, particularly of splicing webs which are used in the manufacture and/or processing of smokers' products. The method comprises the steps of advancing the running web along a predetermined path (e.g., toward the wrapping station of a cigarette making machine), maintaining the leader of the fresh web at a location adjacent a portion of the path for the running web, placing a uniting band (both sides of which are adhesive) between the aforementioned location and the aforementioned portion of the path for the running web, gradually accelerating the fresh web to the speed of the running web including applying to the leader of the fresh web a tensional stress ahead of the uniting band, confining successive increments of the fresh web at the aforementioned location to movement in the general direction of movement of the running web, shifting at least one of the webs against the respective adhesive side of the uniting band and toward the other web so that the uniting band adheres to the other web to thereby connect the webs to each other and moves with the running web, severing the running web behind the moving uniting band, relaxing the tensional stress upon the fresh web ahead of the moving uniting band, and thereupon severing the fresh web ahead of the moving uniting band.

The stress relaxing step preferably includes changing the direction of movement of the fresh web ahead of the moving uniting band.

The method preferably further comprises the steps of monitoring the speed of the running web (e.g., by resorting to a tachometer generator which is operatively associated with the prime mover for the means which advances the running web along the aforementioned path), monitoring the speed of the fresh web in the course of the accelerating step (e.g., by resorting to a shunt in the control unit for the motor which drives the accelerating means for the fresh web), comparing the monitored speeds of the running and fresh webs, and initiating the shifting step when the speed of the fresh web matches the speed of the running web.

The stress relaxing step is preferably initiated in automatic response to start of the shifting step.

The method preferably further comprises the step of maintaining the tensional stress upon the fresh web at a constant value in the course of the accelerating step; such constant value is preferably only slightly less than the tensile or breaking strength of the fresh web. This insures rapid acceleration of the fresh web from zero speed to the speed of the running web and reduces waste in the material of the fresh web.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a partly elevational and partly diagrammatic view of an apparatus which embodies one form of the invention, the means for forming splices being shown in idle position.

DESCRIPTION OF THE PREFERRED EMBODIMENTS

The apparatus which is shown in the drawing comprises a mobile support 1 with bearing members 2a, 2b for an expiring reel 3a of thin, porous cigarette paper web 12a and a fresh reel 3b of cigarette paper web 12b, two regulators 4a, 4b which respectively adjust the braking action upon the reels 3a, 3b, automatic splice forming means 6 (hereinafter called splicer), and a control circuit 7 for the splicer 6.

The support 1 further comprises a two-armed carrier 9 which is mounted on a fixed pivot member 8 and can be turned through 180 degrees so as to move the bearing member 2b into the space occupied by the bearing member 2a, and vice versa. Suitable detent means (not shown) is provided to releasably or yieldably hold the carrier 9 in either of the two positions. Reference may be had to German Offenlegungsschrift No. 1,774,765 which discloses such detent menas. The bearing members 2a, 2b are respectively mounted on shafts 11a, 11b which are rotatable in the corresponding arms of the carrier 9. The running web 12a is trained over guide rolls 13a, 14a and 17a which are mounted on the carrier 9. The roll 14a is a dancer roll; it is mounted on a lever 18a which is pivotable on a shaft 19a and is biased clockwise, as viewed in the drawing, by a helical spring 21a so that the roll 14a loops the web 12a between the guide rolls 13a and 17a. A further guide roll 16a on the left-hand arm of the carrier 9 is idle when the web 12a is running; this roll is active when the carrier 9 is turned through 180 degrees and the expiring reel 3a is replaced with a fresh reel, not shown.

The fresh web 12b is trained over guide rolls 13b, 14b, 16b which are mounted on the right-hand arm of the carrier 9. The roll 14b is a dancer roll which is mounted on a lever 18b pivotable on a shaft 19b and biased by a helical spring 21b so as to loop the web 12b between the guide rolls 13b and 16b. The guide roll 17b is not in use; this roll becomes active when the carrier 9 is rotated through 180 degrees so that the reel 3b takes the place of the reel 3a. The remnant of the expiring reel 3a is then removed and the bearing member 2a receives a fresh reel whose web is trained over the guide rolls 13a, 14a and 16a while the guide roll 17a remains idle until the carrier 9 returns to the position which is shown in the drawing. Such pivoting of the carrier 9 automatically entails disengagement of the fresh web from the guide roll 16a and engagement of the fresh web with the guide roll 17a. The dancer rolls 14a, 14b tension the respective webs in regions between the guide rolls 13a, 17a and 13b, 16b.

The shafts 11a, 11b respectively constitute the output elements of two torque-transmitting devices 22a, 22b which are mounted at the rear side of the carrier 9, which serve to brake the respective reels 3a and 3b, and each of which constitutes a d-c motor. The regulators 4a and 4b respectively serve to insure that the armature currents of the motors 22a, 22b remain constant, i.e., that such currents do not deviate from a preselected value, as long as the tensional stresses upon the webs 12a, 12b respectively remain constant or fluctuate within a predetermined narrow range. The dancer rolls 14a, 14b form part of or constitute two detectors 23a, 23b which respectively monitor the tensional stresses upon the webs 12a, 12b. To this end, the shafts 19a, 19b are respectively turnable with the levers 18a, 18b and carry the sliders of two potentiometers 24a, 24b which are mounted at the rear side of the carrier 9. The potentiometers 24a, 24b respectively constitute component parts of the regulators 4a, 4b. The regulator 4a further comprises a signal comparing stage 26a one input of which is connected with the potentiometer 24a and whose output is connected with a current regulating circuit 28a forming part of a control unit 27a. The latter further comprises an amplifier 29a which is connected with the circuit 28a, with an energy source 129a and with a shunt 31*a* for the motor 22*a*. The corresponding parts of the regulator 4*b* are denoted by similar reference characters. Thus, the signal comparing stage is shown at 26*b*, the control unit at 27*b*, and the elements of the control unit 27*b* at 28*b*, 29*b*, 129*b* and 31*b*. The shunts 31*a*, 31*b* are connected in the armature circuits of the respective d-c motors 22*a*, 22*b*.

It will be understood that the motors 22*a*, 22*b* can be replaced with generators having means (e.g., one or more variable resistors in the armature circuit) for maintaining the value of the armature current constant as long as the tensional stress upon the respective web does not change.

The shafts 11*a*, 11*b* respectively drive tachometer generators 32*a*, 32*b* which monitor the RPM of the respective shafts and are connected with the fixed contacts of a two-position switch 33. The movable contact of the switch 33 connects the output of the tachometer generator 32*a* with the corresponding input of a dividing circuit 34 when the tachometer generator 32*a* monitors the RPM of the shaft (11*a*) for the expiring web (12*a*). When the carrier 9 is rotated through 180 degrees, it automatically changes the position of the moving contact of the switch 33 so that the latter connects the upper input of the circuit 34 with the tachometer generator 32*b*. The moving contact of the switch 33 may be actuated directly by the carrier 9 or by a trip which shares the movements of or moves in synchronism with the carrier.

The second or lower input of the dividing circuit 34 receives signals from a further tachometer generator 36 which monitors the RPM of the main prime mover 37 (e.g., a variable-speed electric motor) of the machine which consumes or processes the running web (12*a*). Such machine may constitute a machine for the production of plain cigarettes, a filter cigarette making machine, a packing machine for plain or filter tipped cigarettes or any other machine (preferably but not necessarily a tobacco processing machine) which must receive a continuous web of wrapping or other material. The main prime mover 37 transmits torque to at least one of two cooperating advancing rolls 38 for the running web 12*a*. The rolls 38 draw the web 12*a* off the reel 3*a*. Signals which are furnished by the tachometer generator 36 denote the speed of the running web 12*a*.

The output of the dividing circuit 34 is connected with one input of a signal comparing circuit 39 which further receives signals from a source 41 (e.g., an adjustable potentiometer) of reference signals. The output of the circuit 39 transmits signals to one input of an electric switch 42 which closes when the intensity of signal from the circuit 39 is within a range which is indicative that the intensity of signal which is transmitted by the dividing circuit 34 exceeds the intensity of reference signal from the source 41. Such situation prevails when the diameter of the expiring reel 3*a* decreases to or below a predetermined minimum value at which the RPM of the reel 3*a* increases to the extent which is necessary to cause the dividing circuit 34 of the control circuit 7 to furnish a signal which initiates the operation of the splicer 6. In other words, the circuit 39 closes the switch 42 when the ratio of rotational speed of advancing rolls 38 to rotational speed of the expiring reel 3*a* reaches a predetermined minimum value. Reference may be had to the commonly owned German Offenlegungsschrift No. 2,323,502.

The splicer 6 is similar to that which is disclosed in the commonly owned U.S. Pat. No. 3,749,634 to Krause. This splicer comprises a fixedly mounted rotatable roller-shaped splicing member 43. The leader 12B of the fresh web 12*b* is trained over the splicing member 43 and its foremost part extends into the nip of two advancing or accelerating rolls 46 one of which is driven by a d-c motor 47. When the motor 47 is on, the advancing rolls 46 pull the leader 12B downwardly, as viewed in the drawing. The splicer 6 further comprises a second rotary roller-shaped splicing or web shifting member 51 which is adjacent to and is movable toward and away from the splicing member 43. That portion of the leader 12B which is disposed between the splicing member 43 and advancing rolls 46 is trained over two guide rollers 44 and 45. The guide roller 45 is coaxial with a shaft 76 for a pivotable carrier 77 which is biased in a clockwise direction, as viewed in the drawing, by a helical spring 78 and supports a pin for the guide roller 44. The carrier 77 has an extension (e.g., a stud or tooth) which normally engages a complementary extension of a blocking device 83 pivotable on a shaft 82 and biased toward engagement with the carrier 77 by a helical spring 81.

The blocking device 83 can be disengaged from the carrier 77 by the lower arm of a two-armed lever 49 which is fulcrumed at 48 and whose upper arm supports the splicing or shifting member 51. The lever 49 is biased in a counterclockwise direction by a helical spring 52. The fulcrum 48 for the lever 49 is coaxial with a guide roller 50 for the running web 12*a*. The spring 52 maintains the upper arm of the lever 49 in engagement with the tip of a reciprocable armature 55 forming part of an electromagnet 53 which is energized when the leader 12B of the fresh web 12*b* is to be attached to the running web 12*a*. The webs 12*a* and 12*b* are then attached to each other by an adhesive-coated uniting band 57 which is separably supported by a suitable holding means or holder 56 in a manner as disclosed in the aforementioned patent to Krause. The holder 56 is mounted slightly ahead of the splicing members 43, 51, as considered in the direction of travel of the running web 12*a*. Both sides of the uniting band 57 are coated with adhesive. When the processing machine including the main prime mover 37 is in operation, the running web 12*a* contacts or is adjacent to the splicing member 51 but is spaced apart from the uniting band 57 and from the fixedly mounted splicing member 43 (i.e., from the leader 12B of the fresh web 12*b*).

The upper arm of the lever 49 supports a trimming knife 58 whose cutting edge is preferably serrated and which serves to sever the running web 12*a* behind the splice. A stationary second trimming knife 61 is adjacent to the roller 50 and its preferably serrated cutting edge serves to sever the leader 12B in front of the splice. The separated portion of the leader 12B descends into a collecting receptacle 84.

The guide roller 44 and its carrier 77 constitute a means for abruptly relaxing the tensional stress upon the leader 12B immediately subsequent to the making of a splice. The tensional stress is reduced in response to disengagement of the blocking device 83 from the carrier 77; the spring 78 is then free to pivot the carrier 77 against a fixed stop 79. The blocking device 83 is disengaged from the carrier 77 in response to energization of the electromagnet 53; the armature 55 is then caused to move in the direction indicated by arrow 54 and pivots the lever 49 against the opposition of the spring 52, i.e., the armature actuates the splicing or shifting roller 51 so that the latter connects the uniting band 57 with the webs 12*a* and 12*b*.

The holder 56 for the uniting band 57 is preferably mounted in suitable ways (not shown) and is removed or displaced by hand upon completion of each splicing operation so as to allow for convenient attachment of a fresh uniting band. The force with which the band 57 adheres to the holder 56 is small, i.e., such force cannot prevent separation of the uniting band from its holder when the electromagnet 53 is energized to move the splicing or shifting member 51 toward the splicing member 43 and to thus cause the webs 12*a*, 12*b* to adhere to the respective sides of the uniting band therebetween.

The control circuit 7 further comprises means for insuring that the armature current for the d-c motor 47 remains constant, i.e., that it corresponds to a referance value selected by an adjustable potentiometer 62 whose output is connected to one contact of the switch 42. The reference signal which is furnished by the potentiometer 62 can reach a signal comparing stage 63 when the switch 42 is closed by the circuit 39. The output of the junction 63 transmits signals to the current regulating circuit 66 of a control unit 64 which is analogous to the control unit 27*a* or 27*b* and further comprises an amplifier 67, an energy source 167 and a shunt 68 for the motor 47.

A device 69 for actuating the splicer 6 comprises a signal comparing circuit 71 which is connected with the output of the tachometer generator 36 and with the output of the control unit 64 and transmits signals to an amplifier 72 for the electromagnet 53. The right-hand input of the circuit 71 receives voltage signals from the shunt 68 and causes the amplifier 72 to energize the electromagnet 53 when the speed of the web 12*a* equals the speed of the web 12*b*, i.e., after the motor 47 is started to accelerate the web 12*b* from zero speed to the speed of the web 12*a*. In other words, the signal which is generated by the shunt 68 denotes the speed of the fresh web 12*b*.

It will be noted that the control circuit 7 for the splicer 6 constitutes a means for monitoring the speed of the web 12*b*; such speed is proportional to intensity of the signal at the output of the control unit 64.

If desired, the speed of the fresh web 12*b* can be monitored in a different way. For example, the apparatus can comprise a tachometer generator which is driven by the motor 47 and transmits signals to the right-hand input of the circuit 71. Also, the monitoring means may comprise a pulse generator having a disk driven by one of the rollers which are rotated by or drive the fresh web 12*b*.

The actuating device 69 energizes the electromagnet 53 when the speed of the running web 12*a* is matched by the speed of the accelerated web 12*b*.

The output of the circuit 71 is further connected with an input of the switch 42 to open the latter when the electromagnet 53 is energized, i.e., when the splicer 6 is actuated.

The operation:

When the diameter of the expiring reel 3*a* is reduced to a predetermined value, the quotient of signals from the tachometer generators 32*a* and 36 (at the output of the dividing circuit 34) reaches an intensity which exceeds the intensity of the reference signal from the potentiometer 41. The circuit 39 then closes the switch 42 so that the potentiometer 62 can transmit a reference signal to the junction 63. This starts the d-c motor 47 for the advancing rolls 46. The regulator 66 and the amplifier 67 of the control unit 64 insure that the current for the armature of the d-c motor 47 remains constant. The signal which the shunt 68 transmits to the junction 63 is proportional to such current. The setting of the potentiometer 62 is such that the motor 47 accelerates the rolls 46 (and hence the fresh web 12*b*) to a predetermined speed within the shortest possible interval of time without causing the web 12*b* to break. Thus, the acceleration of advancing rolls 46 is effected in such a way that the tensional stress upon the web 12*b* is only slightly below that value at which the web 12*b* breaks. The increased tensional stress upon the web 12*b* entails a pronounced counterclockwise pivotal movement of the lever 18*b* against the opposition of the spring 21*b* (the roll 14*b* moves toward the guide rolls 13*b* and 16*b*) whereby the slider of the potentiometer 24*b* assumes a position in which the d-c motor 22*b* is disconnected from the energy source 129*b*. In other words, the braking torque of the motor 22*b* is reduced to zero.

The RPM of the motor 47 (and of the advancing rolls 46) is ascertained by monitoring the armature voltage of the motor 47. The corresponding signal is transmitted (by shunt 68) to the right-hand input of the circuit 71 in the actuating device 69. The circuit 71 compares the intensity of such signal with the intensity of signal which is transmitted by the tachometer generator 36 for the main prime mover 37, and the output of the circuit 71 transmits a signal to the amplifier 72 when the ratio of the intensities of signals representing the armature voltage of the motor 47 and the RPM of the prime mover 37 reaches a preselected value, i.e., when the speed of the fresh web 12*b* equals the speed of the running web 12*a*. It will be noted that the RPM of the output element of the prime mover 37 is proportional to the speed of advancing rolls 38 and hence to the speed of the running web 12*a*. In other words, the circuit 71 compares the speed of the fresh web 12*b* with the speed of the running web 12*a*. The amplifier 72 energizes the electromagnet 53 so that the armature 55 pivots the lever 49 against the opposition of the spring 52 (arrow 54) whereby the splicing or shifting member 51 moves toward the splicing member 43 and causes the uniting band 57 to adhere to the webs 12*a* and 12*b*. The attraction between the uniting band 57 and the webs 12*a*, 12*b* exceeds the force with which the uniting band adheres to its holder 56; therefore, the uniting band is separated from the holder and moves with the webs 12*a*, 12*b* toward and beyond the guide roller 50.

The triming knife 58 shares the pivotal movement of the lever 49 and its serrated cutting edge severs the web 12*a* behind the splice, i.e., the splice is separated from the remnant of the expiring web 3*a*.

When the armature 55 pivots the lever 49, the lower arm of the lever 49 disengages the blocking device 83 from the carrier 77 so that the latter pivots under the action of the spring 78 until arrested by the stop 79. The guide roller 44 abruptly relaxes the tensional stress upon the web 12*b* in front of the freshly formed splice (i.e., in front of the moving uniting band 57) so that the web 12*b* forms a small loop above the serrated cutting edge of the trimming knife 61. The splice advances toward the periphery of the roller 50 and the leader of the web 12*b* continues to move toward and through the nip of the advancing rolls 46. Therefore, the knife 61 separates the leader of the web 12*b* from the next-following portion of this web immediately in front of the splice which thereupon advances toward and beyond the nip of the advancing rolls 38. The separated leader of the web **12*b* descends into the collecting receptacle 84**.

The signal which is transmitted by the output of the signal comparing circuit 71 opens the switch 42 so that the source 62 of reference signals is separated from the signal comparing stage 63. Consequently, the motor 47 is arrested but not before the separated leader of the web **12*b* (which is now the running web) descends into the receptacle 84. The motor 47 can be arrested shortly before the entire separated leader of the web 12*b* descends into the receptacle 84 because the inertia of rotary parts of the motor 47 and of the rolls 46 suffices to effect the delivery of separated leader into 84**.

The tensional stress upon the running web **12*b* between the reel 3*b* and the advancing rolls 38 is determined by the motor 22*b* whose armature current (such current is proportional to braking torque) is constant because one input of the signal comparing stage 26*b* receives a reference signal from the potentiometer 24*b*. The other input of the stage 26*b* receives a signal from the shunt 31*b* (such signal denotes the actual armature current of the motor 22*b*). The braking action upon the reel 3*b* is always proportional to the tensional stress upon the running web 12*b*, even if such tensional stress changes, because the magnitude of tensional stress is monitored by the potentiometer 24*b*. In other words, the braking torque which is furnished by the motor 22*b* is always determined by the reference signal which is furnished by the potentiometer 24*b***.

When the splicing operation is completed, the holder 56 is withdrawn from the aforementioned ways and receives a fresh uniting band 57. The carrier 9 is pivoted clockwise through 180 degrees to move the reel **3*b* to the position previously occupied by the expired reel 3*a*. At the same time, the carrier 9 causes the switch 33 to connect the upper input of the dividing circuit 34 with the tachometer generator 32*b*. Such pivoting of the carrier 9 results in disengagement of the running web 12*b* from the guide roll 16*b* and engagement with the guide roll 17*b***.

In the next step, the attendant removes the expired reel **3*a* from the bearing member 2*a* and replaces it with a fresh reel. The leader of the fresh reel is threaded through the apparatus in the same way as shown for the leader 12*b*, i.e., such leader is trained over the guide rolls 13*a*, 14*a*, 16*a*, around the splicing member 43 and guide rollers 44, 45, and is introduced into the nip of the advancing rolls 46. Prior to such threading, the carrier 77 is pushed back to the illustrated position in which it is thereupon held by the blocking device 83. The holder 56 is returned to the position which is shown in the drawing and the apparatus is ready for the next splicing operation which takes place as soon as the speed of the expiring reel 3*b* rises to a predetermined value at which the circuit 39 closes the switch 42**.

The improved apparatus is susceptible of various modifications without departing from the spirit of the invention. For example, the tensional stress upon the fresh web **12*b* ahead (downstream) of the moving uniting band 57 could be relaxed by providing means for reducing the speed of the motor 47 and advancing rolls 46 as soon as the electromagnet 53 actuates the shifting member 51 so that the latter moves the web 12*a* laterally against the uniting band 57 and the uniting band moves laterally against the adjacent increment of the fully accelerated fresh web 12*b*. The stress relaxing means (44, 77, 78) which is shown in the drawing is preferred at this time because it can effect an abrupt relaxation of tensional stress upon the surplus of the leader 12B by the simple expedient of disengaging the blocking device 83 from the carrier 77 so that the resilient element 78 is free to move the guide roller 44 from the illustrated (first) end position to that (second) end position in which the carrier 77 abuts against the stop 79. Such movement of the guide roller 44 under the action of the resilient element 78 results in pronounced relaxation of tensional stress upon the leader 12B, i.e., the tensional stress which is applied by the guide roller 44 decreases from a higher first to a lower or lesser second value with the result that the speed of the surplus of the leader 12B decreases and the surplus can be readily separated by the knife 61 which is held in a suitable stationary frame member (not shown) between the location where the web 12*b* is contacted by the respective side of the uniting band 57 and the locus of the accelerating means 46, 47. Rapid relaxation of tensional stress upon the leader of the web 12*b* is desirable in order to insure that the leader will form a relatively small loop in the region between the guide roller 44 (in the second end position of this roller) and the knife 61. Such rapid relaxation of tensional stress is much less likely to take place in response to deceleration of the accelerating means 46, 47. Moreover, abrupt but fully controlled and reproducible deceleration of motor 47** would contribute significantly to bulk, initial and maintenance cost as well as sensitivity of the apparatus.

The placing of trimming knife 61 close to the shifting member 43 of the splicer 6 is desirable in order to reduce the dimensions of the apparatus.

It is also possible to employ a discrete second electromagnet or the like for disengagement of blocking device 83 from the carrier 77 in response to generation of a (third) signal (at the output of the circuit 72) which denotes that the intensity or another characteristic of the (first) signal (generated by the device 36) denoting the speed of the running web **12*a* is fully matched by the same characteristic of the (second) signal (generated by the shunt 68) which denotes the speed of the fresh web 12*b*. In either case, the step of relaxing the tensional stress upon the leader 12B ahead of the moving uniting band 57 takes place in automatic response to acceleration of the web 12*b* to the speed of the running web 12*a***.

It is also possible to replace the stress relaxing guide roller 44 and its carrier 77 with a device which is reciprocable between two end positions for the purpose of abruptly reducing the tensional stress upon the web **12*b* ahead of the freshly formed splice. Also, the helical spring 78 can be replaced by another resilient element or by a pneumatic device which biases the carrier 77 toward the stop 79. Finally, the splicer 6 can be modified by providing it with means for moving the splicing member 43 toward the uniting band 57 simultaneously with movement of the splicing or shifting member 51 toward the member 43**.

An important advantage of the improved method and apparatus is that the tensional stress upon the leader of the fresh web increases gradually, also at the time when the fresh web and the running web are caused to contact the uniting band 57. This greatly reduces the likelihood of breaking of the fresh web. The splicing members 43, 51 insure that each adhesive-coated side of the uniting band 57 comes into full contact with the respective web so that the uniting band can form a strong and reliable splice. The acceleration of the fresh web to the speed of the running web takes place within a short interval of time because the tensional stress upon the non-convoluted portion of the fresh web is always only slightly less than that stress which would result in breakage of the fresh web. Moreover, the acceleration of the fresh web to the speed of the running web is not affected by unpredictable parameters because the tensional stress upon the web 12*b* is automatically held at a value slightly below the breaking stress. Rapid acceleration of the fresh web to the speed of the running web brings about another important advantage, namely, that the portion of the fresh web which is discarded (by descending into the receptacle 84) is surprisingly short.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. A method of splicing a fresh web to a running web, particularly of splicing webs which are used in the manufacture and/or processing of smokers' products, comprising the steps of advancing the running web along a predetermined path; maintaining the leader of the fresh web at a location adjacent a portion of said path; placing a uniting band, both sides of which are adhesive, between said location and said portion of said path; gradually accelerating the fresh web to the speed of the running web, including applying to the leader of the fresh web a tensional stress ahead of the uniting band; confining successive increments of the fresh web at said location to movement in the general direction of movement of the running web; shifting at least one of the webs against the uniting band and toward the other web so that the uniting band connects the webs to each other and moves with the running web; severing the running web behind the moving uniting band; relaxing the tensional stress upon the fresh web ahead of the moving uniting band; and thereupon severing the fresh web ahead of the moving uniting band.

2. A method as defined in claim 1, wherein said relaxing step includes changing the direction of movement of the fresh web ahead of the moving uniting band.

3. A method as defined in claim 1, further comprising the steps of monitoring the speed of the running web, monitoring the speed of the fresh web in the course of said accelerating step, comparing the monitored speeds of the running and fresh webs and initiating said shifting step when the speed of the fresh web matches the speed of the running web.

4. A method as defined in claim 1, further comprising the step of initiating said relaxing step in automatic response to start of said shifting step.

5. A method as defined in claim 1, further comprising the step of maintaining the tensionsl stress upon the fresh web at a constant value in the course of said accelerating step.

6. A method as defined in claim 5, wherein said constant value is slightly less than the tensile strength of the fresh web.

7. Apparatus for splicing a fresh web to a running web by means of a uniting band which is adhesive at both sides thereof, particularly for splicing webs which are used in the manufacture and/or processing of smokers' products, comprising means for advancing the running web along a predetermined path; means for maintaining the leader of the fresh web at a location adjacent a portion of said path; means for separably holding a uniting band between said location and said portion of said path; means for gradually accelerating the fresh web to the speed of the running web, including means for applying a tensional stress to the leader of the fresh web ahead of said holding means; means for confining successive increments of the fresh web at said location for movement in the general direction of movement of the running web; splice forming means including means for shifting at least one of the webs against the uniting band and toward the other web in response to acceleration of the fresh web to the speed of the running web so that the uniting band connects the webs to each other and moves with the running web; means for severing the running web behind the moving uniting band; means for relaxing the tensional stress upon the fresh web ahead of the moving uniting band; and means for thereupon severing the fresh web ahead of the moving uniting band.

8. Apparatus as defined in claim 7, wherein said last mentioned severing means comprises a stationary knife adjacent said path downstream of said holding means, as considered in the direction of movement of the running web.

9. Apparatus as defined in claim 8, wherein said accelerating means is located downstream of said knife, as considered in the direction of movement of the fresh web.

10. Apparatus as defined in claim 7, wherein said stress relaxing means comprises a guide member disposed intermediate said last mentioned severing means and said accelerating means, and carrier means supporting said guide member for movement between a first position which said guide member assumes during acceleration of the fresh web to the speed of the running web and applies to the fresh web a first tensional stress and a second position in which said guide member applies to the fresh web a lesser second tensional stress.

11. Apparatus as defined in claim 10, wherein said stress relaxing means further comprises means for moving said guide member to said second position in response to actuation of said shifting means.

12. Apparatus as defined in claim 11, wherein said means for moving said guide member to said second position includes resilient means.

13. Apparatus as defined in claim 11, further comprising means for blocking the movement of said guide member to said second position during acceleration of the fresh web and means for deactivating said blocking means in response to actuation of said shifting means.

14. Apparatus as defined in claim 13, wherein said deactivating means includes a mobile support for said shifting means.

15. Apparatus as defined in claim 7, further comprising means for generating first signals denoting the speed of the running web, means for generating second signals denoting the speed of the fresh web, means for comparing said first and second signals and for generating a third signal when the speed of the fresh web matches the speed of the running web, and means for actuating said shifting means in response to generation of said third signal.

16. Apparatus as defined in claim 15, wherein said actuating means comprises an electromagnet.

17. Apparatus as defined in claim 7, wherein said stress applying means includes means for pulling the leader of the fresh web, a motor for said pulling means and control means arranged to maintain the driving torque of said motor at a predetermined value.

18. Apparatus as defined in claim 17, wherein said control means includes a source of reference signals denoting said predetermined value and means for regulating the supply of energy to said motor in response to said signals.

* * * * *